US005799470A

United States Patent [19]

Sautter et al.

[11] Patent Number: 5,799,470

[45] Date of Patent: Sep. 1, 1998

[54] PACKING MACHINE

[75] Inventors: Manfred Sautter, Dettingen; Hannes Neumüller, Frickenhausen; Jens Kallfass, Nürtingen, all of Germany

[73] Assignee: Kallfass Verpackungsmaschinen GmbH & Co., Nurtingen, Germany

[21] Appl. No.: 852,526

[22] Filed: May 7, 1997

[30] Foreign Application Priority Data

Sep. 5, 1996 [DE] Germany ..... 196 18 559.9

[51] Int. Cl.[6] ..... B65B 9/06; B65B 59/00

[52] U.S. Cl. ..... 53/550; 493/302

[58] Field of Search ..... 53/450, 550, 551; 493/476, 479, 302

[56] References Cited

U.S. PATENT DOCUMENTS

| | | | |
|---|---|---|---|
| 3,636,826 | 1/1972 | Bowen et al. . | |
| 4,194,438 | 3/1980 | Schmachtel . | |
| 4,210,237 | 7/1980 | Gram . | |
| 4,494,362 | 1/1985 | Koch | 53/550 |
| 4,537,016 | 8/1985 | Shanklin et al. . | |
| 4,658,569 | 4/1987 | Hanagata | 53/550 |
| 4,671,047 | 6/1987 | Mugnai . | |
| 4,761,937 | 8/1988 | Francioni | 53/550 |
| 5,165,221 | 11/1992 | Udelson et al. | 53/550 |
| 5,337,542 | 8/1994 | Omori | 53/550 |
| 5,408,806 | 4/1995 | Lin et al. | 53/550 |
| 5,603,202 | 2/1997 | Hanagata | 53/550 |

FOREIGN PATENT DOCUMENTS

| | | |
|---|---|---|
| 11 64 918 | 3/1964 | Germany . |
| 31 14 102 A1 | 2/1982 | Germany . |
| 38 37 441 A1 | 5/1990 | Germany . |
| 40 21 934 | 1/1992 | Germany . |
| 40 21 934 C2 | 1/1992 | Germany . |
| 40 21 935 C2 | 6/1992 | Germany . |
| 397 517 | 8/1965 | Switzerland . |

*Primary Examiner*—Horace M. Culver

*Attorney, Agent, or Firm*—Gary M. Nath; Nath & Associates

[57] ABSTRACT

The present invention relates to a packing machine for packing articles (4) in a film (5), with a tube shaping device (1) for shaping a tube from a film which is substantially flat prior to tube shaping and a transporting device (2) for transporting the articles into the tube, the tube shaping device having several pairs of shaping edges (12, 17, 18) for deflecting or reversing the film. The packing machine is characterized in that the shaping edges (12, 17, 18) are positioned relative to one another in such a way that the path over the shaping edges along lines parallel to the borders (11) of the film (5) from an entrance of the film into the tube shaping device (1) up to its exit therefrom, is shorter in the vicinity of the film borders than in a central region of the film.

19 Claims, 6 Drawing Sheets

PACKING MACHINE

FIELD OF THE INVENTION

The present invention relates to a packing machine for packing articles in a film or foil, having a tube shaping device for shaping a tube from a film which is substantially flat prior to tube shaping and a transporting device for transporting the articles into the tube, the tube shaping device having several pairs of shaping edges for deflecting the film.

BACKGROUND OF THE INVENTION

A packing machine of the aforementioned type is known from DE 40 21 934 A1. In this conventional packing machine the tube or hose forming or shaping device has several baffle plates with substantially three pairs of shaping edges around which the film is successively passed. A first, wing-like baffle plate guides the packing film in a downwardly inclined manner counter to the transporting direction of the articles to be packed, the film being deflected by means of the first baffle plate and two further baffle plates arranged in shear-like manner and is shaped to form a tube, which passes out in the transporting direction of the articles to be packed. The individual shaping edges of the baffle plates are so mutually positioned that, independently of the shaping edge or the area of the baffle plates over which it passes, the film is uniformly stretched and flat, i.e. passes in distortion-free manner over the edges. Shaping edges over which the film successively passes are located pairwise in a common plane.

However, such packing machines are unsatisfactory with respect to the film guidance through the tube shaping device.

SUMMARY OF THE INVENTION

An object of the present invention is therefore to give a packing machine with an improved tube shaping device of the aforementioned type. In particular, an overstressing of the film is to be avoided and an overstretching of the film prevented.

In the case of a packing machine of the aforementioned type, the invention solves this problem in that the shaping edges are so mutually positioned that the path over the shaping edges along lines parallel to the film borders is shorter from an entrance of the film into the tube shaping device up to its exit from the tube shaping device in the vicinity of the film borders than in a central region of the film.

The film is guided over the shaping edges in such a way that the film borders run in tension-free or loose manner over the shaping edges. Therefore the advantage is obtained that the film is protected at the borders from excessive tension and overstretching.

Surprisingly, despite the non-constant tension distribution, the film runs in crease-free manner over the tube shaping device. It has hitherto been assumed that the path over the shaping edges parallel to the film borders must be of uniform length for all film regions, so as to prevent the film running together towards its central region and consequently giving rise to creases. The opposite is in fact the case. The film guided or pulled over the shaping edges attempts to pass by the shortest route over the shaping edges and transversely to the film longitudinal direction is slightly tightened towards the borders, so that no creases or folds arise.

According to a preferred embodiment of the invention, the film or parts thereof pass successively over first shaping edges of a first shaping shoulder and second and third shaping edges of a second shaping shoulder. Preferably, in each case one of the first shaping edges and an associated second shaping edge, i.e. over which passes the same film portion, are not located in a plane. The shaping edges of the same shaping edge pair can be located in a common plane.

Edges over which the film successively passes are consequently oriented askew relative to one another. It has hitherto been assumed that shaping edges over which the film successively passes must be located in one plane, in order to guide the film in crease-free, uniformly tensioned manner over the shaping edges of the tube shaping device. Contrary thereto, according to an advantageous embodiment of the invention, in each case one of the first shaping edges and an associated second shaping edge are so positioned relative to one another that the film is staggered between the first and second shaping edges. This has the advantage that the film is guided gently and loosely over the shaping edges.

The first shaping shoulder can be separate from the second shaping shoulder, i.e. not connected thereto and is appropriately located above the second shaping shoulder. Preferably the first shaping shoulder is constructed as a trapezoidal, particularly multipiece sheet metal part and the second shaping shoulder, which is substantially located in the transporting plane of the transporting device, has two substantially triangular sheet metal portions, which mutually overlap in shear-like manner, so that the third shaping edges converge and overlap one another in the tube exit direction and that the second shaping edges move apart in the tube exit direction. The shaping shoulders can be made from different materials, but a sheet metal construction thereof offers advantages with respect to simple, stable design. In place of a flat, plate-like construction of the shaping shoulders, they can also be rack-like in such a way that in skeleton-like manner the shaping edges are provided, but the plate-like sheet metal construction offers advantages with respect to a uniform, gently sliding film guide.

According to a further development of the invention the angular orientation of at least one of the shaping edge pairs, particularly the first shaping edges is adjustable. The degree of staggering of the film running over the shaping edges and the path difference quantity between the regions in which the film border runs and the region in which a central portion of the film runs over the shaping edges is adjustable. Thus, the tension distribution in the film and the bulge of the film at its borders between successively following shaping edges can be adjusted.

It has hitherto been assumed that an arrangement of the shaping edges corresponding to a predetermined condition for the path lengths of different lines parallel to the film borders over the shaping edges functioned in the same way for different films, but this is not the case. The adjustability of the angular orientation of at least certain shaping edges has the advantage that the geometry of the tube shaping device can be adapted to different films with different thicknesses and made from different materials. The angular orientation is also adjustable as a function of the size of the articles to be packed, so as to draw the film in optimum manner over the tube shaping device in the case of different articles, which require a different tube geometry and different overlap widths. In particular it is consequently possible to adjust to what extent the film border runs loosely over the shaping edges and the tension can be differently distributed within the film. The corresponding, adjustable shaping edges have an adjustment range, that said shaping edges with the in each case associated shaping edges of the next shaping edge pair are not located in one plane and there is always a staggering of the film guided over the shaping edges and the marginal areas of the film are guided in tension-free, loose manner.

Advantageously the shaping edges can in each case be swivelled or pivoted in a common plane. The mutual angle of the shaping edges in said plane is consequently adjustable. Preferably the first shaping shoulder has two plates, which are located in a common plane and in each case have a first shaping edge, the plates being swivellable about an axis perpendicular to the common plane. Thus, the plates can be swivelled in the plane defined by them. Thus, the first shaping shoulder can be swivelled as a whole around a substantially horizontal axis, so that the effective angle of the first shaping edges relative to the second shaping edges is adjustable, but the previously described embodiment offers advantages with respect to a simple swivel mounting of the shaping shoulder plates.

According to an advantageous embodiment of the invention the first and second shaping edges intersect in the extension thereof at one point, the first shaping edges being more spread than the second shaping edges. Preferably the orientation of the shaping edges is such that also the projection of the angle formed between the first shaping edges in the plane of the second shaping edges is larger than the angle bounded between the second shaping edges.

The shaping edges can be displaceable in translatory manner and preferably the shaping edges are displaceable pairwise in in each case opposite directions and at least one pair of shaping edges is displaceable relative to the further shaping edges, particularly in such a way that a height and width of the tube shaped from the film is adjustable.

In a packing machine of the aforementioned type the articles to be packed are conventionally delivered on the side of the tube shaping device facing the side on which the film shaped to the tube passes out of the tube shaping device and are transported through the tube shaping device between the shaping shoulders into the exiting tube. It is known to introduce the transporting device or, in the case of multipart construction thereof a portion of said device into the tube shaping device, in order to be able to transport the corresponding article over the shaping plates into the exiting tube. However, this known construction has a relatively complicated design and is unsatisfactory from a space-economy standpoint.

According to another feature of the invention, a packing machine with an improved transporting device is provided, in which in particular the transporting device brings about a reliable transportation of articles of different sizes with different settings of the tube shaping device into the tube shaped from the film and for this the position of a downstream end of the transporting device is adjustable.

In the vicinity of the tube shaping device there is no transporting device and the articles are indirectly transported by the actual film into the vicinity of the tube shaping device.

The downstream end of the transporting device is adjustable in such a way that the articles to be transported, also in the case of different settings of the tube shaping device, in an always direct manner up to the tube shaping device and can be engaged on the film running in said device. Between the end of the transporting device and the tube shaping device there is no gap or only a minimum gap, which could impede the forward movement of the article to be transported.

Preferably the downstream end of the transporting device is synchronously adjustable with the movable shaping shoulder of the tube shaping device. Thus, the adjustable end of the transporting device is so coupled with the movable shaping shoulder that in the case of an adjustment of the shaping shoulder, e.g. for different geometries of the articles to be packed, simultaneously and automatically there is a corresponding adjustment of the transporting device, so that the end of the latter terminates directly at the shaping shoulder and no larger gap is formed between the transporting device and the shaping shoulder.

According to a further development of the invention, an effective transporting path of the transporting device is longitudinally adjustable. This offers the advantage that the upstream end of the transporting device can be fixed, particularly following onto a supply for the articles and simultaneously the position of the downstream end of the transporting device is adjustable.

Preferably the downstream end of the transporting device is adapted to a facing contour of the tube shaping device and preferably a leading edge of said tube shaping device over and beyond which the articles are shoved in to said device has a V-shape and the downstream end of the transporting device extends in tongue-like manner into the V-shaped recess of the tube shaping device. In order to allow an adjustment of the tube shaping device, without colliding with the transporting device, the downstream end of the transporting device can be moved backwards and forwards in the transporting direction in such a way that the complimentary V-shaped end of the transporting device moves back if the V-shaped opening of the tube shaping device has been constricted in shear-like manner, so as to set a smaller width of the tube obtained from the film.

Advantageously the transporting device has at least one continuous conveying means passing round reversing means, the conveying means being guided at the downstream conveying end of the transporting device around a displaceable reversing unit. In particular, the displaceable reversing unit by means of which the conveying means are guided in S-shaped manner, is located between two fixed reversing means and can be moved backwards and forwards parallel to the straight portions of the conveying means between the reversing unit and the two fixed reversing means. The conveying means is fixed pretensionable without any special tensioning device, such as e.g. tension pulleys. A longitudinal adjustment of the conveying path, i.e. a displacement of the reversing unit, can be brought about without any length change of the path covered by the conveying means. Advantageously, as a result the conveying means has a uniform tension, which is not impaired by inertia effects, such as e.g. takes place with a compensating roller, which is normally used for tensioning continuous belts.

Preferably, the transporting device has a plurality of narrow, parallel-running conveyor belts and preferably the conveyor belts are guided at the downstream end of the transporting device about pulleys displaced in stepped manner, so that the downstream end is adapted in stepped manner to the V-shaped front of the tube shaping device. The pulleys can be mounted on a common, displaceable slide and can be displaceable synchronously with one another parallel to the conveying direction.

Preferably, a discharge device for transporting away the articles enveloped in the tube at an exit side of the tube shaping device is connected substantially flush thereto. This has the advantage that the articles can be taken up directly at the outlet from the tube shaping device by said discharge device. Preferably, the discharge device has a suction belt conveyor, in which the articles enveloped in the tube are sucked onto a conveyor belt. The suction also brings about the transportation of the tube passing out of the tube shaping device if no articles are enclosed therein. The suction brings about the necessary adhesion of the tube to the conveyor belt. The discharge device could also have an electrostatic attraction of the film to the conveyor belt, but the suction of the exiting tube offers advantages with respect to stable static friction between film and conveyor belt, particularly in the case of different films.

With a packing machine of the aforementioned type having adjustable shaping shoulders, different articles can be packed, in that the setting of the tube shaping device is modified. Particularly with small lot sizes, i.e. if only a small number of identical articles is to be packed and the tube shaping device has to be adjusted relatively frequently, an easy, rapid setting is important.

According to another feature of the invention, an automatically adjustable packing machine is provided and in particular there is an adjusting device for adjusting the tube shaping device for different articles to be packed, as well as a control device for controlling the adjusting device as a function of article parameters, such as e.g. the length, width, height, etc. of the article.

Thus, no manual adjustment or setting of the tube shaping device is necessary and instead it is performed automatically by the adjusting device as a function of article parameters in accordance with the particular article to be packed. Thus, the time necessary for changeover can be reduced, so that the productivity of the packing machine is increased.

The article parameters can e.g. be inputted manually by a corresponding input unit. However, preferably, the packing machine has a storage or memory device for storing the article parameters associated with a particular article, the control device reading by means of a reader the corresponding article parameters from the storage device and controlling the adjusting device as a function of said stored parameters.

According to an embodiment of the invention an input unit is provided with which the article to be packed can be inputted. Corresponding to the choice of the article to be packed, the control device reads from the storage device the article parameters associated with said article in order to correspondingly control the adjusting device.

In order to adjust the tube shaping device for a new article to be packed, it is consequently only necessary to input or select the corresponding article. The tube shaping device is then automatically brought into the necessary setting.

In place of the input unit, it would also be possible to provide a detection device with the aid of which the article to be packed is automatically detected. Corresponding to the result of the automatic detection, the article parameters are read from the memory in order to control the adjusting device. The adjusting device can be followed by an evaluating unit to evaluate which stored article corresponds to or is closest to the detected article.

However, the previously described construction with a manual inputting of the article to be packed offers advantages with regards to a simple construction and input reliability.

The adjusting device can have several actuators or servomotors, which are in each case associated with different movement axes or spindles of the tube shaping device and are controlled by the control device. Preferably such servomotors are associated both with the translatory displacement spindles or axes and the angular adjustment spindles or axes of the tube shaping device. The servomotors can be in the form of stepping motors, an indirect path measurement taking place by counting the stepping pules. In the case of servomotors, there can be a direct path measurement by a pulse generator and an evaluation in a suitable control means.

Preferably the adjusting device is coupled to the transporting device. Therefore the transporting device is adapted automatically to the article to be packed and the corresponding tube shaping device setting. In addition, as a result of the control device following units, such as e.g. a film welding device can be controlled. Through the inputting or detection of the article to be packed, a completely automatic setting of the packing machine is obtained.

It is particularly advantageous that through the described control device the setting up of the tube shaping device for completely new articles to be packed can be simplified, in that initially the known article closest to the new article is selected. The control device then brings about a presetting in accordance with the parameters stored for the known article. A fine setting can e.g. take place after a trial run. For this purpose a parameter input unit is preferably provided.

These and other features can be gathered from the claims, description and drawings, the individual features representing either alone or in the form of subcombinations, advantageous, independently protectable constructions for which protection is hereby claimed. The invention is described hereinafter relative to an embodiment.

However, this embodiment does not necessarily represent the full scope of the invention and reference must be made therefore to the claims for interpreting the scope of the invention.

DETAILED DESCRIPTION OF THE PREFERRED EMBODIMENT

Figure 1:
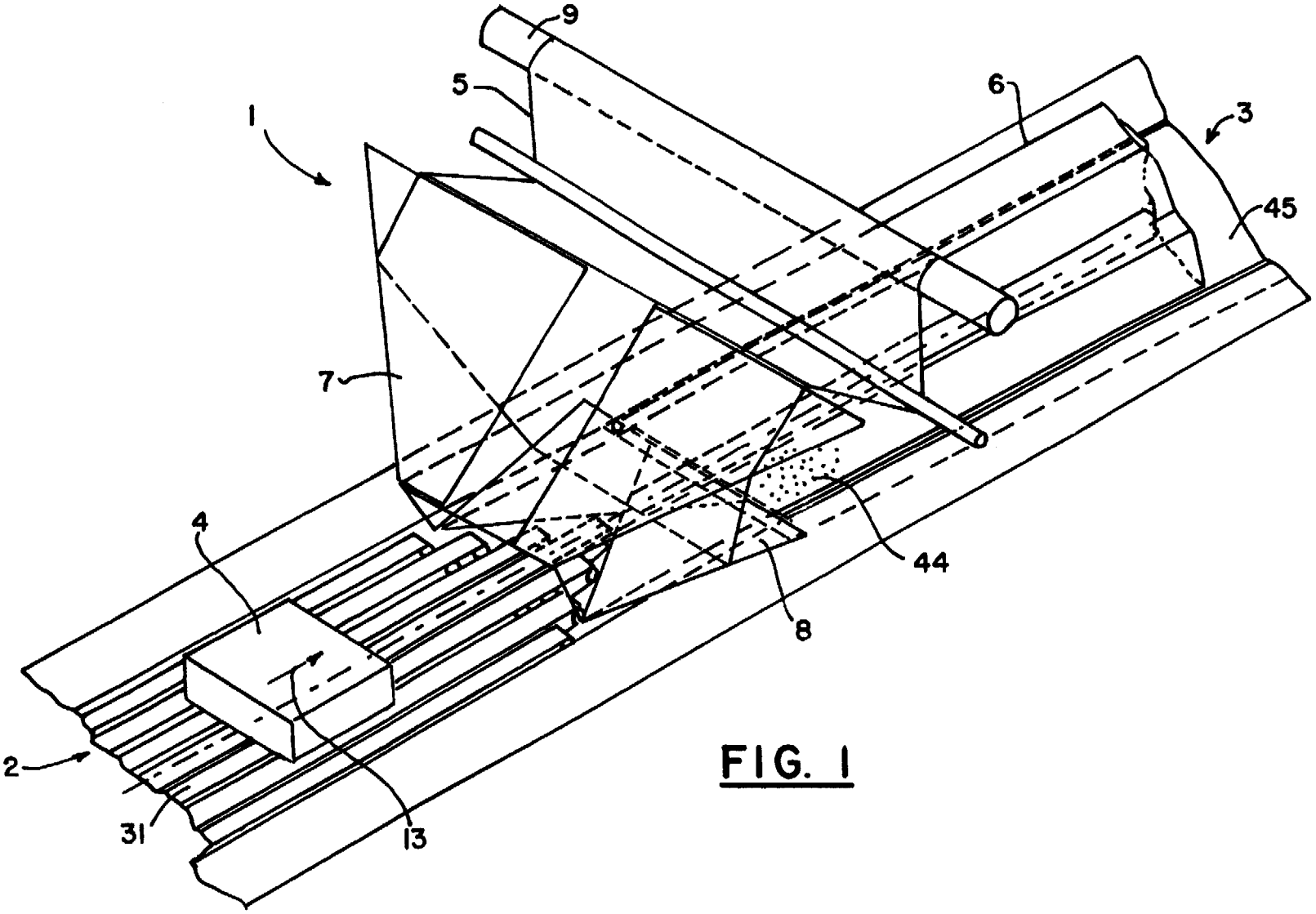
FIG. 1 A perspective view diagrammatically showing a detail of a packing machine with a transporting device on which is transported an article, a tube shaping device with shaping shoulders over which passes a film, and a discharge device at the downstream end of the tube shaping device.

The packing machine has a tube shaping device 1, a transporting device 2, with which the articles 4 to be packed are transported through the tube shaping device 1 into a tube 6 shaped from the film 5, and a discharge device 3, which conveys away the tube 6 and the articles 4 located therein out of and away from the tube shaping device 1 (FIG. 1).

The tube shaping device 1 has an upper, first shaping shoulder 7 and a lower, second shaping shoulder 8 (FIG. 4), over which is successively guided the film 5, which is taken from a supply reel 9 by means of a compensating roller 10, in order to pass out of the tube shaping device 1 as a tube 6. The tube 6 essentially has a rectangular cross-section, the borders 11 of the film 5 overlapping on the bottom of the tube 6.

The two shaping shoulders 7 and 8 essentially span two planes, which are inclined to one another and intersect roughly in the transporting plane defined by the transporting device 2. The lower, second shaping shoulder 8 is essentially in the conveying plane of the transporting device 2, whereas the upper, first shaping shoulder 7 rises in the conveying direction 13 in such a way that the film 5, drawn over the upper shaping shoulder 7, is supplied from top right to bottom left in FIG. 4.

Figure 5:
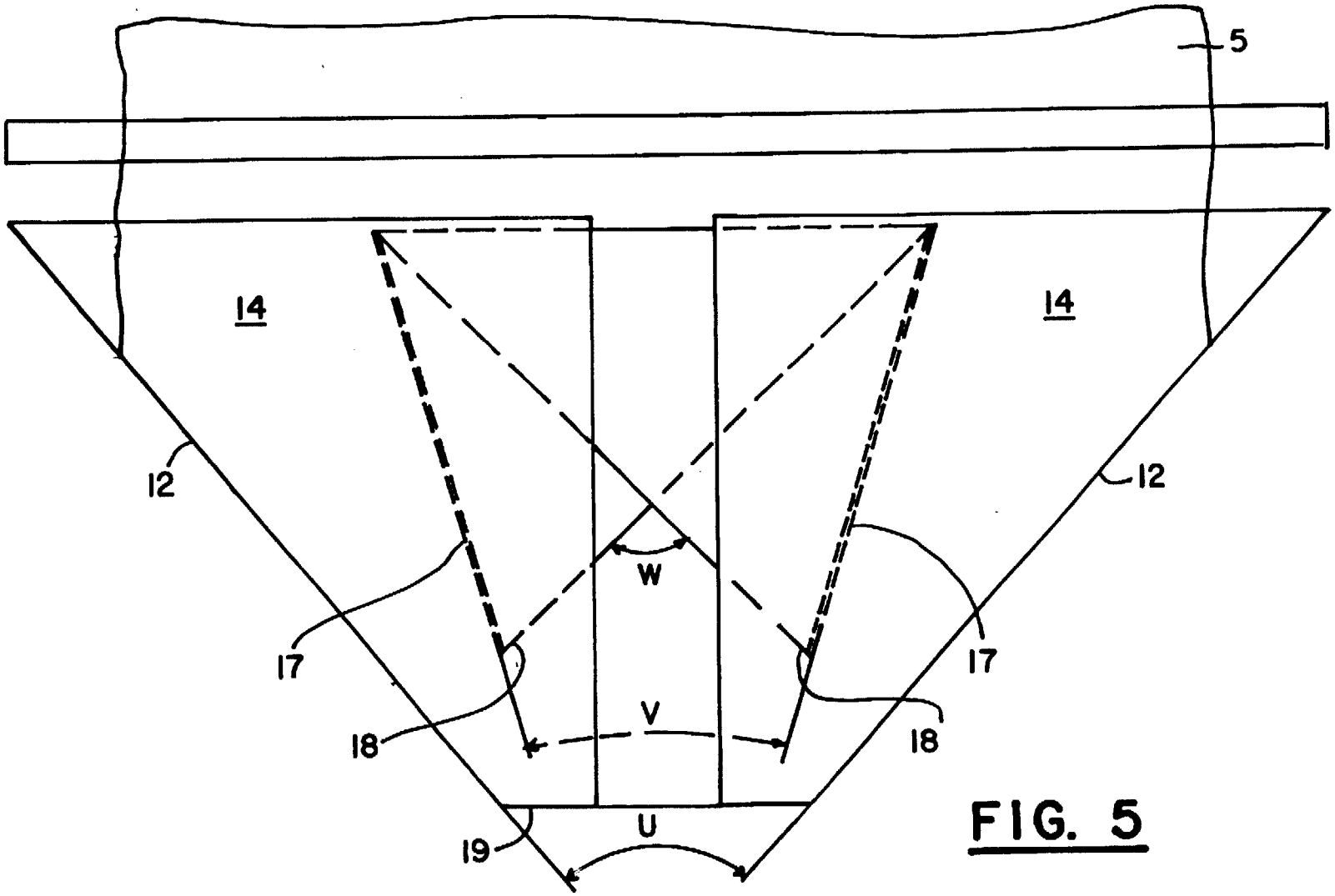
FIG. 5 A plan view of the tube shaping device according to the previous drawings, which shows the arrangement of the shaping shoulders similar to FIG. 4.

The shaping shoulders 7 and 8 have several pairs of shaping edges over which the film 5 is guided and bent in order to be shaped into the tube 6. On its outsides, the upper shaping shoulder 7 has a first shaping edge pair 12, over which the outer marginal areas of the film 5 are initially guided close to the borders 11 thereof before they reach the lower shaping shoulder 8. The first shaping edges 12 are located in a common plane, namely in the plane of the shaping shoulder 7 and converge in the direction of the film 5 drawn over the first shaping shoulder 7. The extensions of the shaping edges 12 intersect under a convergence angle u (FIG. 5). As shown in FIG. 1 the first shaping shoulder 7 has two baffle plates 14, which in each case have one of the shaping edges 12 and are movable, as will be described hereinafter, in order to adjust the guidance and tension of the film 5 and the geometry of the exiting film tube 6. The baffle plates 14 are sheet metal plates.

The lower, second shaping shoulder 8 also has two baffle plates 15 and 16, but which unlike the baffle plates 14 are not located in a single plane, but in two parallel planes and mutually overlap, and between said two baffle plates 15 and 16 is formed a narrow horizontal gap in accordance with the orientation of FIG. 1, through which can be guided the film 5, as will be explained hereinafter.

The two baffle plates 15 and 16 are substantially triangular and together have a second shaping edge pair 17 located on the outsides of the shaping shoulder 8 and a third shaping edge pair 18, which overlap one another and define a V-shaped opening on the front of the shaping shoulder 8. As shown in FIG. 5, the second shaping edges 17 diverge in the direction of the tube 6 passing out of the tube shaping device 1. Extensions of the second shaping edges 17 intersect under a convergence angle v. The third shaping edges 18 converge in the direction of the exiting tube 6 and define in the projection on the conveying plane of the transporting device 2 an angle w.

A fourth shaping edge pair 19 over which the film 5 is guided, is positioned on a front side of the upper shaping shoulder 7 and is located on a common line.

Figure 4:
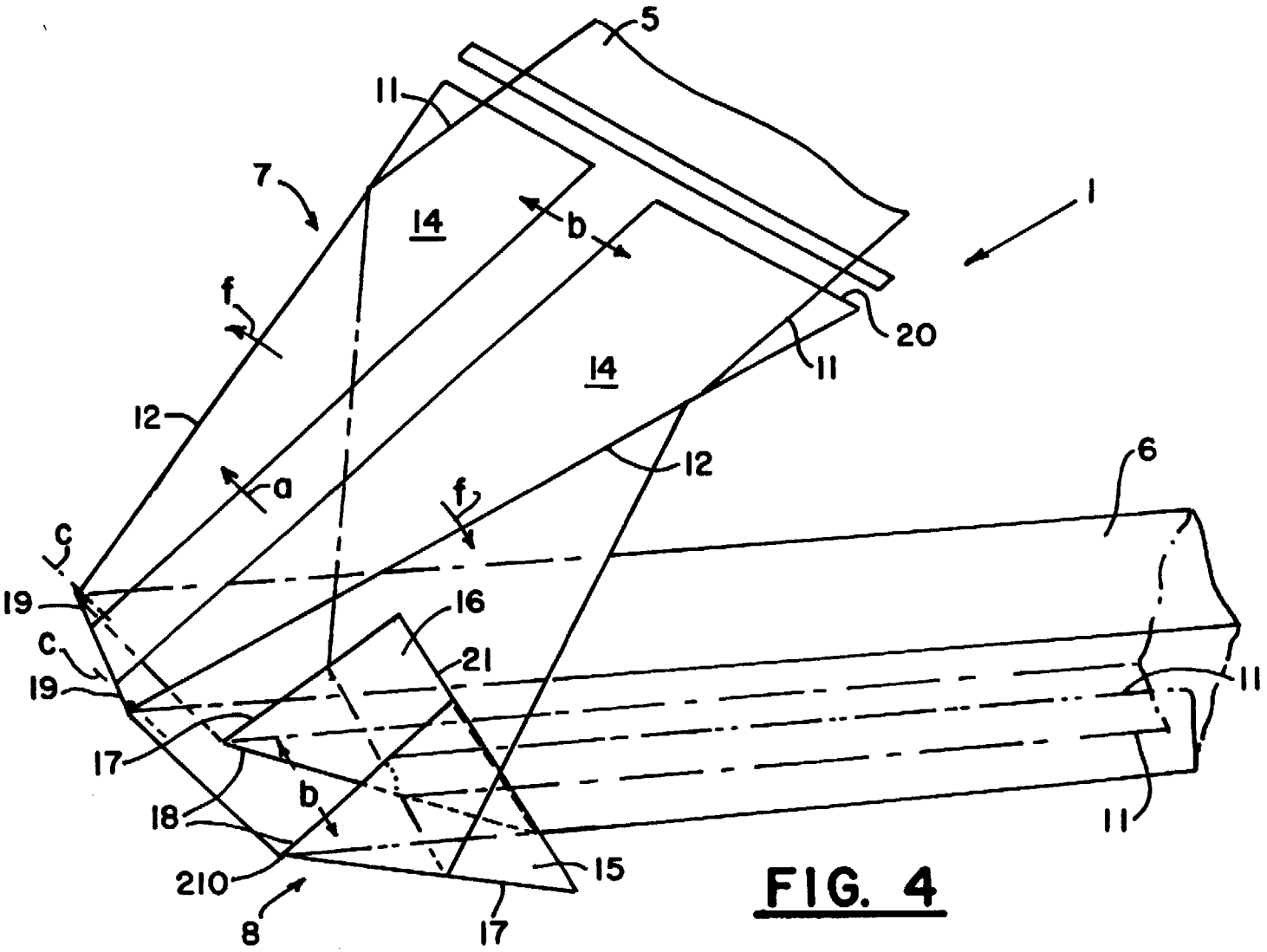
FIG. 4 A perspective view of the shaping shoulders of the tube shaping device, diagrammatically showing the mutual arrangement of individual shaping edges and their mobility, as well as the guidance of the film drawn over the individual shaping edges.

The mutual arrangement of the shaping edges is such that the path over the different shaping edges 12, 17, 18 and 19 along different lines, which are in each case parallel to the film borders 11, measured from an entrance of the film 5 into a tube shaping device 1 at an entrance edge 20 up to the exit of the film 5 on a vertical cross-section of the tube 6 at the trailing edges 21 of the lower shaping shoulder 8 is of differing length. In particular, said path is shorter in areas close to the borders 11 of the film 5 than in areas towards the median longitudinal axis of the film 5. As will be described hereinafter, as a result the borders 11 pass loosely and in untensioned manner over the shaping edges and form a bulge in particular in the area between the first shaping edges 12 and the second shaping edges 17 (FIG. 4).

As shown in FIG. 5, the first shaping edge 12 and second shaping edge 17 over which successively passes the film 5, i.e. according to FIG. 5 in each case a right one of the first and second shaping edges and in each case a left one of the first and second shaping edges, are not located in a common plane and are instead askew to one another. Therefore the film 5 is staggered in the area between the first shaping edges 12 and the second shaping edges 17. As a function of the inclination angle z of the first shaping shoulder 7, a plurality of angular combinations of the angles u, v and w are possible, in order to obtain tension freedom of the borders 11 and the staggering of the film 5 in the area between two associated shaping edges 12 and 17. With an angle z of 45°, the angles u, v and w can e.g. be 70°, 20° and 90°. If the angle u in the plane of the first shaping shoulder 7 is projected into the plane of the angle v located in the conveying plane, the projection of the angle u is always larger than the angle v.

Figure 6:
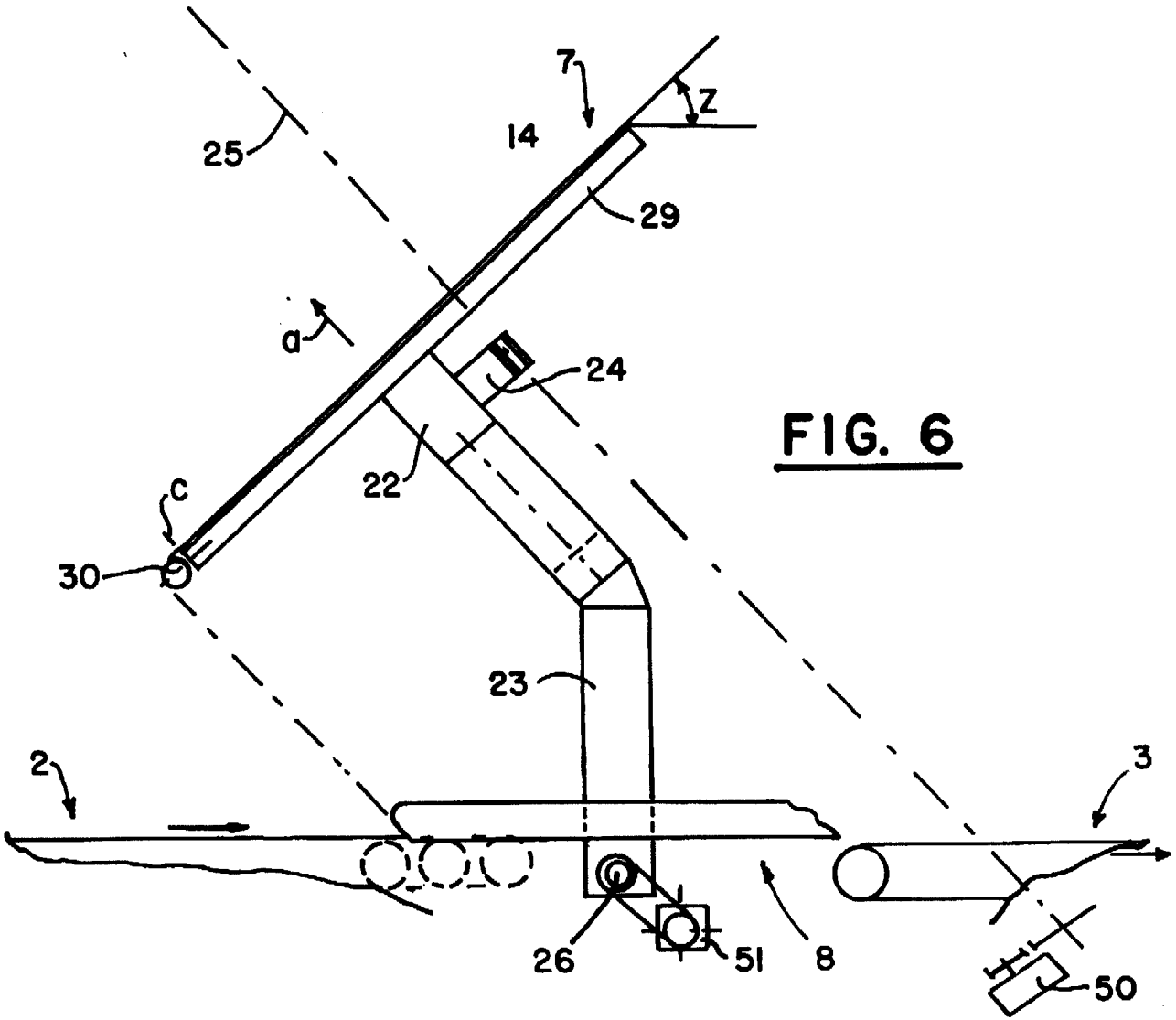
FIG. 6 A side view showing the adjustability of an upper shaping shoulder of the tube shaping device and the arrangement of the transporting device, a lower shaping shoulder and a discharge conveyor in one plane.

In order to be able to adjust the geometry of the tube 6 passing out of the tube shaping device 1 and the tension distribution during the guidance of the film 5 over the individual shaping edges, the shaping edges 12, 17 and 18 are movable around and along different axes. To be able to adjust a height of the tube 6, the first shaping shoulder 7 is displaceable along an axis a parallel to a connecting line of the leading edge 19 of the first shaping shoulder 7 and a leading edge 210 of the second shaping shoulder 8 (FIG. 6). A support 22, which is connected to both baffle plates 14 of the first shaping shoulder 7, is mounted displaceably on a post 23 along the axis a and is in engagement by means of an arm 24 with a spindle 25 for adjusting the height of the first shaping shoulder 7. Thus, there is no need for a hand wheel moving together with the shaping shoulder. The spindle 25 can be driven manually, preferably by means of a servomotor 50.

Figure 2:
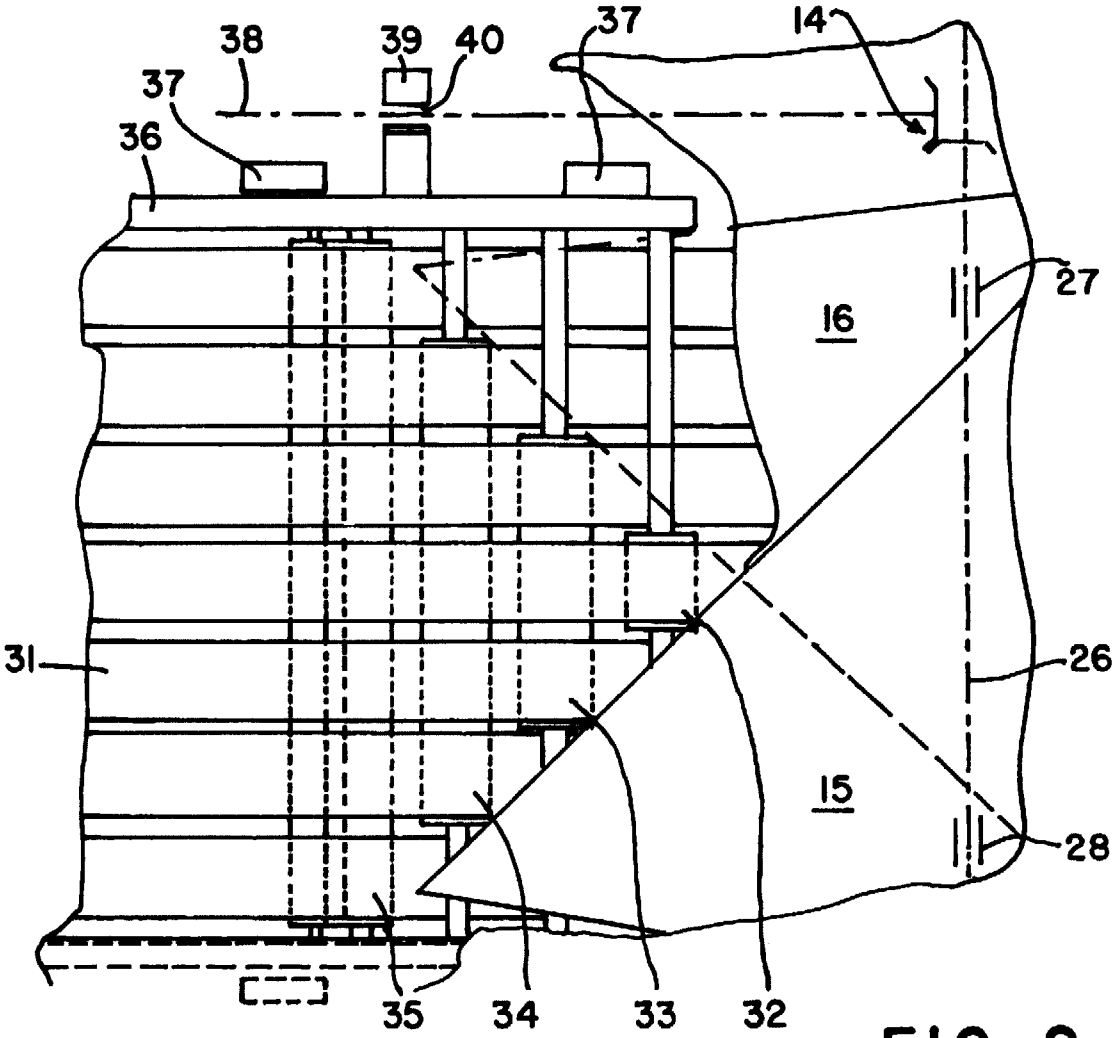
FIG. 2 A plan view of a downstream end of the transporting device with several narrow, parallel conveyor belts and a V-shaped front of the tube shaping device formed by two shaping plates arranged in shear-like manner.

The support 22 and post 23 are in two parts and connected to in each case one of the baffle plates 14, in order to adjust the latter along an axis b at right angles to the conveying direction of the transporting device 2 and consequently a width of the exiting tube 6. The adjustment of the baffle plates 14 of the upper shaping shoulder 7 preferably takes place synchronously with a corresponding width setting of the baffle plates 15 and 16 of the lower shaping shoulder 8 along a direction b. The two posts 23 can be in each case fixed to one of the baffle plates 15 and 16 or can be coupled with the two baffle plates 15 and 16 to a common adjusting spindle 26. As shown in FIG. 2, the two baffle plates 15 and 16 are in engagement by means of a spindle nut 27 or 28 with different, standard portions of the adjusting spindle 26, so that with the operation of the spindle 26 the width of the V-shaped opening of the lower shaping shoulder 8 bounded by the third shaping edges 18 is adjusted. In place of the represented spindle drive it is possible to use other drive, setting or adjusting devices, but said spindle drive, in the case of a simple construction also has a high precision. The spindle 26 can be driven manually, preferably by means of a suitable servomotor 51. By synchronous adjustment of the baffle plates 14 of the upper shaping shoulder 7 and the baffle plates 15, 16 of the lower shaping shoulder 8, the track width of the tube shaping device 1 and consequently the width of the exiting tube can be easily adjusted for constant geometrical conditions of the shaping edges.

In order to be able to adjust the tension of the film 5 on the borders 11, the baffle plates 14 of the upper shaping shoulder 7 can be pivoted about in each case one axis c, which is perpendicular to the plane defined by the baffle plates 14. As shown in FIGS. 4 and 6, the axes c are in each case at a lower, outer end of the baffle plates 14. The position of the connection points of the first shaping edge 12 and the fourth shaping edge 19 is the same for different pivoting or swivelling positions of the baffle plates 14, so that the imaginary connection between the fourth shaping edge pair 19 and the tips, i.e. the connection points of the second and third shaping edges, remains unchanged. The convergence angle u is modified by pivoting the baffle plates 14. The adjustment range is such that the convergence angle u or its projection in the plane of the angle v is always larger than the angle v. Thus, there is a staggering of the film 5 in the area between the first shaping edges 12 and the second shaping edges 17.

As shown in FIG. 6, the baffle plates 14 are in each case pivotably mounted on a plate-like base support 29. To achieve a synchronous adjustment of the two baffle plates 14, they can be coupled together, e.g. by means of a spindle, similar to the two baffle plates 15 and 16. For this purpose can also be provided a not shown servomotor. It is also possible for the two baffle plates 14 to be individually pivotable, in order to attain different settings on both shaping edges 12.

As shown in FIG. 6, the fourth shaping edges 19 are formed by cylindrical rolls 30, which are mounted in rotary manner on the base support 29. The rolls 30 reduce the stressing of the film 5 through the relatively acute-angled reversal or deflection at the shaping edge 4 and reduce the friction of the film 5 at said shaping edge.

By adjusting the convergence angle u, the tension of the film 15, as will be explained hereinafter, can be adjusted in the vicinity of the borders 11, as can the bulge of convexity of the film between the first shaping edges 12 and the second shaping edges 17.

In order to transport the articles 4 into the tube 6 fixed by the two shaping shoulders 7 and 8, according to FIG. 1, the transporting device 2 has a plurality of narrow, parallel, running conveyor belts 31, which move the articles 4 onto the lower shaping shoulder 8 or the film 5 drawn over the lower shaping shoulder 8. At the downstream end of the upper strand of the transporting device 2, the conveyor belts 31 are so guided about stepped displaced pulleys 32, 33, 34 and 35, that the ends of the individual conveyor belts 31 are stepped in V-shaped manner and adapted to the V-shaped opening of the lower shaping shoulder 7 defined by the third shaping edges 18. Thus, the conveying path of the transporting device 2 extends directly to the lower shaping shoulder 8, which is in the same plane as the conveying plane of the transporting device 2. In order to obtain a width adjustment of the baffle plates 15 and 16 at right angles to the transporting direction, in the case of a constant, small gap between the transporting device 2 and the V-shaped front of the lower shaping shoulder 8, the complimentary stepped, downstream conveying end of the transporting device 2 can be slid backwards and forwards in such a way that the conveying path of the transporting device 2 is longitudinally adjustable.

The pulleys 32, 33, 34 and 35, which fix the downstream end, are mounted on a common slide 36, which is mounted in the conveying direction by means of sliding or antifriction bearings 35 in displaceable manner on a not shown frame of the packing machine. If the width of the lower shaping shoulder 8 is reduced, i.e. the baffle plates 14 and 15 are moved together or further over one another, the slide 36 is slid back counter to the conveying direction of the transporting device 2, so that the downstream end of said transporting device does not collide with the third shaping edges 18. On widening the lower shaping shoulder 8, i.e. on sliding apart the two baffle plates 15 and 16 at right angles to the conveying direction, the downstream end is moved forwards in the conveying direction, so as to leave no gap between the transporting device 2 and the lower shaping shoulder 8.

The slide 36 is preferably displaceable synchronously to the width setting of the lower shaping shoulder. A slide spindle 38 in engagement with the slide by means of an arm 39 and a spindle nut 40, is coupled by means of a bevel gear pair 41 to the adjusting spindle 26, with which the position of the baffle plates 14, as well as 15 and 16 is adjusted transversely to the conveying direction. The synchronous linking of the slide 16 with the baffle plates 15 and 16 can also take place individually by means of correspondingly controlled servomotors, but the shown coupling between the two spindle drives offers high precision for simple construction. The adjusting spindle 26 and slide spindle 38 can be driven jointly by hand or a suitable servomotor.

Figure 3:
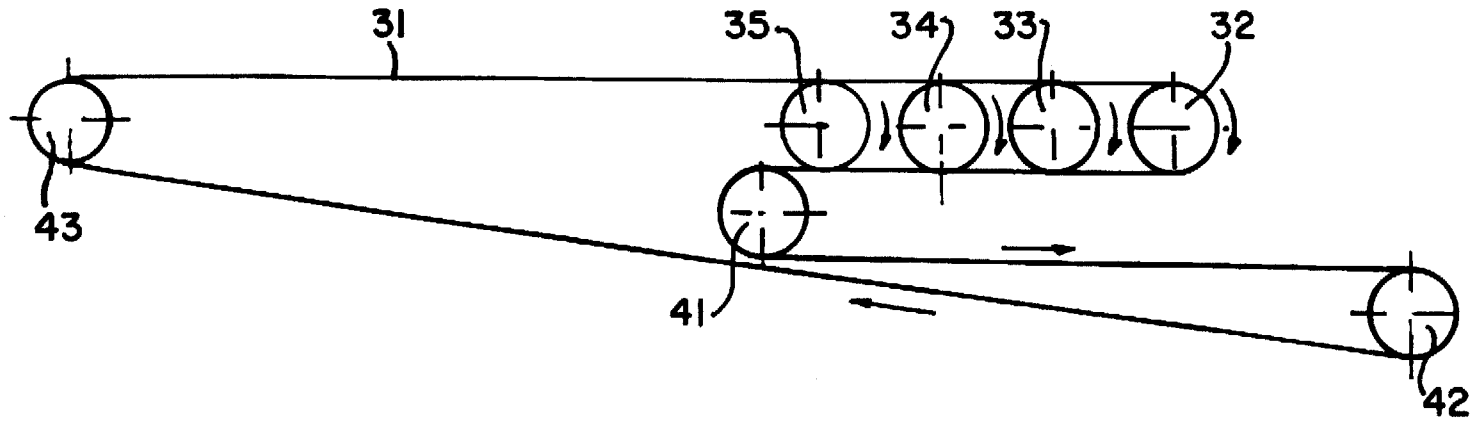
FIG. 3 A diagrammatic view of the conveyor belt guide and arrangement of the guide pulleys of the transporting device according to the previous drawings.

As shown in FIG. 3, the individual conveyor belts 31 are so guided that the path lengths covered by the continuously rotating conveyor belts 31 are the same for different settings of the downstream conveying end of the upper strand of the transporting device 2. The individual conveyor belts 31 are initially guided individually or pairwise about displaceably mounted guide pulleys 32, 33, 34 and 35 and then together about a common guide pulley 41, which is also rotatably mounted on the displaceable slide 36 and is also movable together with the pulleys 32, 33, 34 and 35 in a direction parallel to the conveying direction. Thus, the conveyor belts 31 are guided in S-shaped manner around one of the guide pulleys 32, 33, 34 and 35, and the guide pulley 41. The guide pulleys 32 to 35 and 41 mounted on the slide 36 are placed between two fixed guide pulleys 42, 43 mounted in rotary manner, around which each of the conveyor belts 31 is guided. The portion of the conveyor belts 31 between the guide pulley 43 and the guide pulleys 32 to 35 and the portion of the conveyor belts 31 between the guide pulley 41 and guide pulley 42 pass in parallel planes. The displaceable guide or reversing unit with the guide or reversing pulleys 32 to 35 and 41 can be moved backwards and forwards in the conveying direction parallel to the said planes, in order to set the position of the downstream conveying end of the transporting device 2, the path length covered by the conveyor belts 31 being constant. Therefore the conveyor belts 31 can be subject to a predetermined, constant tension.

For the conveying away of articles 4 on the tube exit side of the tube shaping device 1 a discharge device 3 is provided. The discharge device 3 has a suction conveyor belt 45 perforated by air suction holes 44, which continuously revolve and whose top is located in the plane of the second, lower shaping shoulder 8. The upstream conveying end of the discharge device 3 is connected flush to a trailing edge of the second, lower shaping shoulder 8 and takes over the articles 4 shoved into the tube, as well as the film tube itself downstream of the tube shaping device 1. In the vicinity of the tube shaping device 1, i.e. close to the lower shaping shoulder 8, no conveying means is provided. Transportation of the articles 4 in this area takes place indirectly through the film 5, which is drawn over the baffle plates 15, 16 of the second, lower shaping shoulder 8. The suction conveyor 3 simultaneously acts as a removal device for the film 5 and also in the absence of articles 4 to be packed, draws the film 5 through the tube shaping device 1. In particular, the threading of the film 5 into the tube shaping device 1 is facilitated through this.

For the automatic setting of the tube shaping device 1, the packing machine shown also has a control device and a storage device, not shown in the drawings. Storage takes place in the storage device or memory article parameters associated with the particular articles, such as e.g. height, width, length and other parameters influencing the setting of the tube shaping device, such as e.g. the article colour, film type, necessary melting point, etc. The control device is connected to servomotors, so as to control the same as a function of the stored article parameters.

By means of an also not shown input unit, the article to be packed is chosen and then the parameters stored at the corresponding location are read from the data memory by the control device. The control device calculates therefrom the desired position for the servodrive and controls the latter with corresponding signals. The calculated values are transmitted via a bus system to the motor control. The servomotors move up to the desired position and indicate by means of the bus system to the control means that the position value has been reached. Thus, the tube shaping device is completely automatically set by inputting the article to be packed.

The operation of the packing machine will now be described. Firstly the film 5 is threaded into the tube shaping device 1, for which purpose the film 5 is manually removed from the supply reel and guided over the baffle plates 14 of the upper shaping shoulder 7. The marginal areas of the film 5 are drawn over the first shaping edges 12 of the first, upper shaping shoulder 7 and successively guided round the second and third shaping edges of one of the baffle plates 15 and 16. The portion of the film 5 guided below the baffle plate 15 and the border of the film 5 wrapped round the top of the baffle plate 16 are drawn through the gap between the two baffle plates 15 and 16. The film 5 is drawn to such an extent through the tube shaping device 1 that an adequate portion rests on the discharge device 3.

The width and height of the exiting tube 6 necessary for the particular articles 4 is set by operating the adjusting spindle 26 and the height adjustment spindle 46. This can take place before or after threading the film 5 and is brought about by the control device and the servomotors, which form a motor adjusting means, following a corresponding article input.

By operating the discharge means 3 the film 5 is drawn through the tube shaping device 1. By pivoting the baffle plates 14 the orientation of the first shaping edges 12 can be set. By pivoting outwards the baffle plates 14 in the direction of the arrow f, the path to be covered by the film in the vicinity of the borders 11 is lengthened, the bulge of the film 5 in the area between the first shaping edges 12 and second shaping edges 17 is reduced and optionally the tension of the film 5 in the marginal areas is increased. A moving together of the baffle plates 14 counter to the arrow f reduces the tension in the marginal areas 11 and increases the bulge formed by the film in the area between the first and second shaping edges 12, 17 respectively. This angular adjustment can also be brought about by the control device, the readjustment optionally taking place by hand or by the manual inputting of corrected set values.

According to FIG. 1, the articles 4 are transported from left to right on the transporting device 2 and shoved into the film tunnel fixed by the shaping shoulders 7 and 8. In the vicinity of the lower shaping shoulder 8, the articles 4 are transported through the film 5 drawn over the lower shaping shoulder B. Downstream of the tube shaping device 1 the articles are transported away by the discharge device 3 and are optionally supplied to a welding mechanism.

We claim:

1. Packing machine for packing articles into a film having a pair of borders and a central area between said borders, said packing machine comprising a tube shaping device for shaping a tube from the film substantially flat prior to tube shaping, and a transporting device for transporting the articles into the tube, the tube shaping device having several pairs of shaping edges for deflecting the film travelling over said shaping edges, wherein the shaping edges are so positioned relative to one another that a path over the shaping edges along lines parallel to the borders of the film from an entrance of the film into the tube shaping device up to an exit from said tube shaping device is shorter in the vicinity of the film borders than in the central area of the film.

2. Packing machine according to claim 1, wherein the tube shaping device has a first shaping shoulder with first shaping edges and a second shaping shoulder with second and third shaping edges the shaping edges of in each case one shaping edge pair being located in a common plane and in each case one of the first shaping edges and an associated second shaping edge are in two different planes.

3. Packing machine according to claim 2, wherein the first shaping shoulder is constructed as a trapezoidal, multipiece sheet metal part and the second shaping shoulder has two substantially triangular sheet metal pieces, which overlap one another in such a way that the third shaping edges converge in a direction towards the exit of the film from the tube shaping device and overlap one another and the second shaping edges move apart in the direction towards the exit of the film from the tube shaping device.

4. Packing machine according to claim 1, wherein at least one of the shaping edge pairs has an angular orientation which is adjustable, said shaping edges being pivotable about in each case one axis perpendicular to a common plane of the shaping edges.

5. Packing machine according to claim 1, wherein the shaping edges of in each case one shaping edge pair move together in their extension and define a convergence angle, the convergence angle of a first pair of shaping edges being larger than the convergence angle of a second pair of shaping edges.

6. Packing machine according to claim 5, wherein a projection of the convergence angle of the first pair of shaping edges in a plane defined by the second pair of shaping edges is larger than the convergence angle of the second pair of shaping edges.

7. Packing machine according to claim 1, wherein the shaping edges are displaceable in translatory manner and pairwise displaceable in in each case opposite directions and at least one pair of the shaping edges is displaceable relative to the further shaping edges.

8. Packing machine for packing articles into a film, said packing machine comprising a tube shaping device for shaping a tube from said film, which is substantially flat prior to tube shaping, said tube shaping device having several pairs of shaping edges for deflecting the film travelling through the tube shaping device, at least one pair of shaping edges being movable and forming a movable shaping shoulder; and a transporting device for transporting the articles into the tube along a transporting direction, wherein the transporting device terminates upstream of the tube shaping device the tube shaping device being free from transporting device and the transporting device has a downstream end which is adjustable with respect to the tube shaping device.

9. Packing machine according to claim 8, wherein the downstream end of the transporting device is adjustable synchronously in accordance with a position of the movable shaping shoulder of the tube shaping device.

10. Packing machine according to claim 8, wherein an effective transporting path of the transporting device is longitudinally adjustable.

11. Packing machine according to claim 8, wherein the downstream end of the transporting device terminates substantially flush with a front of the tube shaping device and is displaceable in accordance with a position of the front of the tube shaping device in the transporting direction of the articles.

12. Packing machine according to claim 11, wherein the tube shaping device has a substantially V-shaped opening and the downstream end of the transporting device extends into said substantially V-shaped opening and is longitudinally adjustable in accordance with a width of the opening transversely to the transporting direction.

13. Packing machine according to claim 8, wherein the transporting device has at least one continuous conveying means revolving about reversing means, the conveying means being guided about a displaceable reversing unit, which fixes the downstream end of the transporting device, the displaceable reversing unit is positioned between a pair of fixed reversing means, the conveying means is guided in substantially S-shaped manner about the displaceable reversing unit and portions of the conveying means extend between the reversing unit and the fixed reversing means in parallel directions, the displaceable reversing unit being displaceable parallel to said portions of the conveying means.

14. Packing machine according to claim 8, wherein the transporting device has a plurality of narrow, parallel-running conveyor belts, which are guided at the downstream end of the transporting device about stepped displaced reversing pulleys so that the downstream end is adapted in stepped manner to a V-shaped opening of the tube shaping device and the reversing pulleys are mounted on a common, displaceable slide and are displaceable synchronously to one another parallel to the transporting direction.

15. Packing machine according to claim 8, further comprising a discharge device for conveying away the articles enveloped in the tube, the discharge device being connected to the tube shaping device substantially flush with an outlet side thereof.

16. Packing machine for packing articles into a film, said packing machine comprising a tube shaping device for shaping a tube from the film substantially flat prior to tube shaping, and a transporting device for transporting the articles into the tube, said tube shaping device having several pairs of shaping edges for deflecting the film travelling through said shaping device, at least one of said shaping edges being adjustable and further comprising an adjusting device for adjusting the tube shaping device for different articles to be packed and a control device for controlling the adjusting device in responce to article parameters characterizing said articles.

17. Packing machine according to claim 16 further comprising storage means for storing sets of article parameters associated with particular articles and wherein the control device is adapted to control the adjusting device in responce to a selected one of the stored sets of article parameters, said control device having an input unit for inputting the article to be packed and a reading unit for reading the set of article parameters corresponding to the input article from the storage device.

18. Packing machine according to claim 16, wherein the adjusting device has servomotors associated with movement axes of the tube shaping device and which are controlled by the control device.

19. Packing machine according to claim 16, wherein the adjusting device is provided for adjusting the transporting device.

* * * * *

UNITED STATES PATENT AND TRADEMARK OFFICE

CERTIFICATE OF CORRECTION

PATENT NO. : 5,799,470

DATED : September 1, 1998

INVENTOR(S) : Sautter et al.

It is certified that error appears in the above-identified patent and that said Letters Patent is hereby corrected as shown below:

On the title page, item [30]; change

"Sep. 5, 1996" to --May 9, 1996--.

Signed and Sealed this

Twelfth Day of January, 1999

*Attest:*

*Attesting Officer*

*Acting Commissioner of Patents and Trademarks*